US008448395B2

(12) United States Patent
Ivarsson

(10) Patent No.: US 8,448,395 B2
(45) Date of Patent: May 28, 2013

(54) WALL FRAMING SYSTEM

(75) Inventor: Niclas Ivarsson, Båstad (SE)

(73) Assignee: Lindab Innovation AB, Bastad (SE)

( * ) Notice: Subject to any disclaimer, the term of this patent is extended or adjusted under 35 U.S.C. 154(b) by 707 days.

(21) Appl. No.: 12/597,228

(22) PCT Filed: Dec. 3, 2007

(86) PCT No.: PCT/EP2007/063133
§ 371 (c)(1),
(2), (4) Date: Jan. 19, 2010

(87) PCT Pub. No.: WO2008/128585
PCT Pub. Date: Oct. 30, 2008

(65) Prior Publication Data

US 2010/0126106 A1 May 27, 2010

(30) Foreign Application Priority Data

Apr. 23, 2007 (DK) ..... 2007 00592

(51) Int. Cl.
*E04B 1/04* (2006.01)
*E04C 2/34* (2006.01)

(52) U.S. Cl. ..... 52/210; 52/481.1

(58) Field of Classification Search ..... 52/204.1, 52/210, 484.1, 243
See application file for complete search history.

(56) References Cited

U.S. PATENT DOCUMENTS 3,536,345 A 10/1970 Leifer
3,831,333 A * 8/1974 Nelsson et al. ..... 52/241
(Continued)

FOREIGN PATENT DOCUMENTS

CA 2293091 A1 6/2001
DE 3231487 A1 3/1984
(Continued)

OTHER PUBLICATIONS

PCT International Preliminary Report on Patentability. International application No. PCT/EP2007/063133. Date of completion of this report: Mar. 8, 2009.

(Continued)

*Primary Examiner* — Andrew Triggs
(74) *Attorney, Agent, or Firm* — Mollborn Patents, Inc.; Fredrik Mollborn

(57) ABSTRACT

The invention relates to a wall framing system (1), comprising a channel member (2 and a stud member (6) for interconnection with said channel member (2), the stud member (6) being insertable between side walls (4, 5) of the channel member (2), and comprising locking means or members (10) for fixating the stud member (6) to the channel member (2), where said locking members (10) are arranged to exert a force on inner surfaces (11, 12) of the side walls (8, 9) of the stud member (6) such that, when the locking means (10) are engaged with the stud member (6), outer surfaces (13, 14) of the side walls (8, 9) of the stud member (6) are pressed against inner surfaces (15, 16) of the side walls (4, 5) of the channel member (2) thereby achieving a frictional engagement between the contacting surfaces of the stud member (6) and the channel member (2). The invention also relates to a stud member (6) for use in a wall framing system (1) as described above. The invention further relates to a method for assembling a wall framing system (1) as described above.

13 Claims, 3 Drawing Sheets

U.S. PATENT DOCUMENTS

| | | | | |
|---|---|---|---|---|
| 3,839,839 | A | 10/1974 | Tillisch et al. | |
| 4,936,067 | A | 6/1990 | Menchetti | |
| 5,218,803 | A * | 6/1993 | Wright | 52/243 |
| 5,274,973 | A * | 1/1994 | Liang | 52/243 |
| 5,313,752 | A * | 5/1994 | Hatzinikolas | 52/243 |
| 5,325,651 | A * | 7/1994 | Meyer et al. | 52/715 |
| 6,176,053 | B1 * | 1/2001 | St. Germain | 52/232 |
| 6,647,691 | B2 * | 11/2003 | Becker et al. | 52/656.1 |
| 6,843,035 | B1 * | 1/2005 | Glynn | 52/573.1 |
| 6,983,569 | B1 * | 1/2006 | Rosenberg | 52/241 |
| 2007/0033884 | A1 * | 2/2007 | Wright | 52/98 |
| 2010/0126106 | A1 * | 5/2010 | Ivarsson | 52/696 |

FOREIGN PATENT DOCUMENTS

| | | | |
|---|---|---|---|
| EP | 1726729 | A1 | 11/2006 |
| EP | 1731687 | A2 | 12/2006 |
| WO | 0014355 | A1 | 3/2000 |

OTHER PUBLICATIONS

International Search Report and Written Opinion of the International Searching Authority. International application No. PCT/EP2007/063133. Date of the actual completion of the international search: Mar. 13, 2009.

* cited by examiner

WALL FRAMING SYSTEM

The invention relates to a wall framing system, comprising:

A channel member having a floor portion and a pair of side walls upstanding from said floor portion;

A stud member having a floor portion and a pair of side walls upstanding from said floor portion for interconnection with said channel member, the stud member being insertable between said side walls of the channel member; and Locking means for fixating the stud member to the channel member.

The invention also relates to a stud member for use in a wall framing system, said stud member having a floor portion and a pair of side walls upstanding from said floor portion.

The invention further relates to a method of assembling a wall framing system, comprising:

A channel member having a floor portion and a pair of side walls upstanding from said floor portion;

A stud member having a floor portion and a pair of side walls upstanding from said floor portion for interconnection with said channel member, the stud member being insertable between said side walls of the channel member; and Locking means for fixating the stud member to the channel member.

Further the invention relates to a method of manufacturing a stud member for a wall framing system.

Finally the invention relates to a method of joining stud members into a length-adjustable stud member.

To build up a framing system for walls in buildings, it is desirable to have a wall framing system which is easy to assemble and has adequate positioning means to provide a certain relative positioning of separate members forming part of the framing system.

A wall framing system comprises channel members to be fastened to a wall, a floor, a ceiling or to configure a border to for example a door opening or a window opening or the like. The framing system further comprises stud members, which stud members are to be placed between the channel members in either a vertical manner or a horizontal manner.

It is well known to secure or fasten the individual stud members to the channel members using screws, nails, rivets or the like to assemble such a wall framing system. Such connection methods are often troublesome and require special tools, such as electric screw-drivers, drills or riveting machines etc.

It is known from U.S. Pat. No. 6,983,569 to have flaps arranged opposite in the side portions or in the floor portion of the channel member, said flaps being positioned in groups or along the channel member at specified distances to each other so that it is possible to place a stud member in a channel member in such a way that the outer sides of the side walls of the stud member come into contact with the inner sides of the side walls of the channel member, the side walls of the stud member resting against the opposite flaps or the flaps fitting into corresponding apertures whereby the stud member is secured to the channel member in at least one direction relative to the longitudinal direction of the channel member. To secure the stud member from moving in other directions relative to the channel member, flaps arranged in predetermined distances are provided in the channel member. When bending these flaps and thereby preventing the movement of the stud in a direction away from the flaps, the stud member is secured in the channel member. The disadvantage of such a system is that the stud member can be placed only at predetermined locations in the channel member.

From U.S. Pat. No. 5,325,651 is known a wall frame structure where a clip bracket is provided to hold plates (channel member) and studs (stud member) together at a predetermined location.

The clip bracket is provided with tongues for insertion through an open top or bottom of an impression adjacent the inner face of the respective wall. The tongues are ganged together by a bridging arm for simultaneous insertion of a pair of through the openings in a confronting pair of impressions.

Using the wall frame system according to U.S. Pat. No. 5,325,651 also entails that the stud member can be placed only at predetermined locations in the channel member, the locations being where the impressions of the channel member are positioned in apertures in the stud member and locked by the clip bracket.

The problems to be solved by the present invention are to eliminate the use of fastening means such as screws, nails, rivets or the like, since they are time consuming to use, and to provide a stepless and flexible way to fasten a stud member to a channel member.

Another object of the invention is to provide an improved arrangement for connecting a wall framing system.

A solution to these problems is to provide a wall framing system according to the present invention, where locking means in the form of locking members are arranged to exert a force on inner surfaces of the side walls of the stud member such that, when a locking member is engaged with the stud member, outer surfaces of the side walls of the stud member are pressed against inner surfaces of the side walls of the channel member, thereby achieving a frictional engagement between the contacting surfaces of the stud member and the channel member.

Hereby it is possible to considerably reduce the erection time of a wall framing system. Further there is no need for tools to assemble the wall framing system, since use of fasteners such as screws, nails, rivets or the like are eliminated.

As long as the width of the stud member corresponds more or less to the inner opening of the C shape or profile of the channel member, it is possible to provide an adequate assembly.

To obtain a more rigid stud member, the side walls of the stud member in an embodiment of the invention can be provided with flanges extending towards each other.

To ensure a high moment and thereby a greater force and friction, the flanges can be arranged on edges of the side walls in an embodiment of the invention.

In an embodiment of the invention the stud member in the wall framing system can be positioned fixed in the channel member by positioning the locking means or locking member in the locking position thereby exerting a force substantially perpendicular to an inner side of the side walls of the stud, and thereby providing an outer side of the side walls exerting a force substantially perpendicular to an inner side of the side walls of the channel member, placing the stud in a fixed position relative to the channel member.

In an embodiment of the invention the stud is a metal stud member.

In an embodiment of the invention the locking member is attached to the stud member.

In an embodiment of the invention the locking member can be moveable between an un-locked position and a locked position, where it is fixating the stud member in the channel member. Hereby is achieved that the stud member can be positioned and locked in any position in the channel member.

In an embodiment of the invention, the locking member can be a knock-out opening.

In an embodiment of the invention one or more knock-out openings can be situated in the stud member.

In an embodiment of the invention one or more knock-out openings can be situated in the floor portion of the stud member. Hereby is achieved, that the stud member can be delivered in standard lengths and subsequently be cut into a needed length, still having locking means to engage with the stud member and fix the stud member in the channel member at a desired position.

In an embodiment of the invention the knock-out opening is situated in a side wall of the stud member In an embodiment of the invention the knock-out opening can be situated in the channel member.

In an embodiment of the invention the knock-out opening can be situated even in the floor portion of the channel member.

Placing a knock out opening in the channel member provides a further support to the positioning of the stud member in the channel member, if needed.

A further solution to the above problems is to provide a stud member for use in a framing system, said stud member having a floor portion and a pair of side walls upstanding from said floor portion, where said stud member is provided with locking members for engagement of said side walls such that, when a locking member is engaged with the stud member, the outer surfaces of the side walls of the stud member are pressed against the inner surfaces of the side walls of the channel member thereby achieving a frictional engagement between the contacting surfaces of the stud member and the channel member.

Hereby is achieved that the stud member can be positioned and locked in any position in the channel member in a flexible and handy way.

In an embodiment of the invention, the locking member is one or more knockout openings.

In an embodiment of the invention, the knock-out opening can be situated in the stud member.

In an embodiment of the invention, the knock-out opening can be situated in the floor portion of the stud member.

In an embodiment of the invention, the knock-out opening is situated in a side wall of the stud member To obtain a more rigid stud member, the side walls of the stud member in an embodiment of the invention can be provided with flanges extending towards each other.

To ensure a high momentum and thereby a greater force, the flanges can be arranged on edges of the side walls in an embodiment of the invention.

Further, the problem mentioned above is solved by a method of assembling a wall framing system, where said method comprises the steps of:

Securing the channel member to a building structure, such as a floor, a wall, a ceiling or the like;

Arranging the stud member between side walls of the channel member in such a way that the side walls of the stud member are substantially parallel to the side walls of the channel member;

Fixating the stud member in the channel member by moving the locking means from an un-locked position to a locked position, thereby achieving a frictional engagement between the contacting surfaces of the stud member and the channel member.

In a further embodiment of the method for assembling a wall framing system the method comprises following successive steps:

Securing the channel member to a building structure, such as a floor, a wall, a ceiling or the like;

Arranging the stud member between side walls of the channel member in such a way that the side walls of the stud member are substantially parallel to the side walls of the channel member;

Fixating the stud member in the channel member by moving the locking means from an un-locked position to a locked position, thereby achieving a frictional engagement between the contacting surfaces of the stud member and the channel member.

Hereby is achieved a method for assembling a wall framing system according to the present invention, where it is possible to fixate a stud member to a channel member without need for tools, and further it is possible to position the stud member in the channel member at a desired position.

An expedient way of providing the profiles of stud members with locking members is achieved according to the invention by the method of manufacturing a stud member for a wall framing system, which method comprises the steps of:

Passing the stud member into a tool, which tool performs a cutting and/or punching action;

Forming at substantially the same time a locking member in the end of one stud member as well as forming a locking member in the end of the next stud member positioned in the tool;

When forming the locking members, the stud members are cut in predetermined lengths;

In an embodiment of the method the tool that performs the cutting and/or punching action is advanced at substantially the same velocity along with the stud members to be cut and punched.

In order to achieve a flexibility of the use of the system as well as to keep down the number of different lengths of stud members to keep in stock, a further advantage of the locking members in the stud member is a possibility to join two stud members into a telescopic member.

This is achieved by a method of joining stud members into a stud member adjustable in length where the method comprises the steps of:

Joining stud members into each other by placing them with the open side of their profile towards each other;

Displacing stud members in relation to each other in their longitudinal direction until they are able to engage with channel members positioned on a floor and in a ceiling;

Activating locking members to lock stud members in their longitudinal direction in relation to each other and activating locking embers to lock the ends of stud members placed in the channel members.

The following further embodiments of the invention will be described with reference to the drawing which shows non-limiting embodiments and variants:

DESCRIPTION OF EMBODIMENTS

Figure 1:
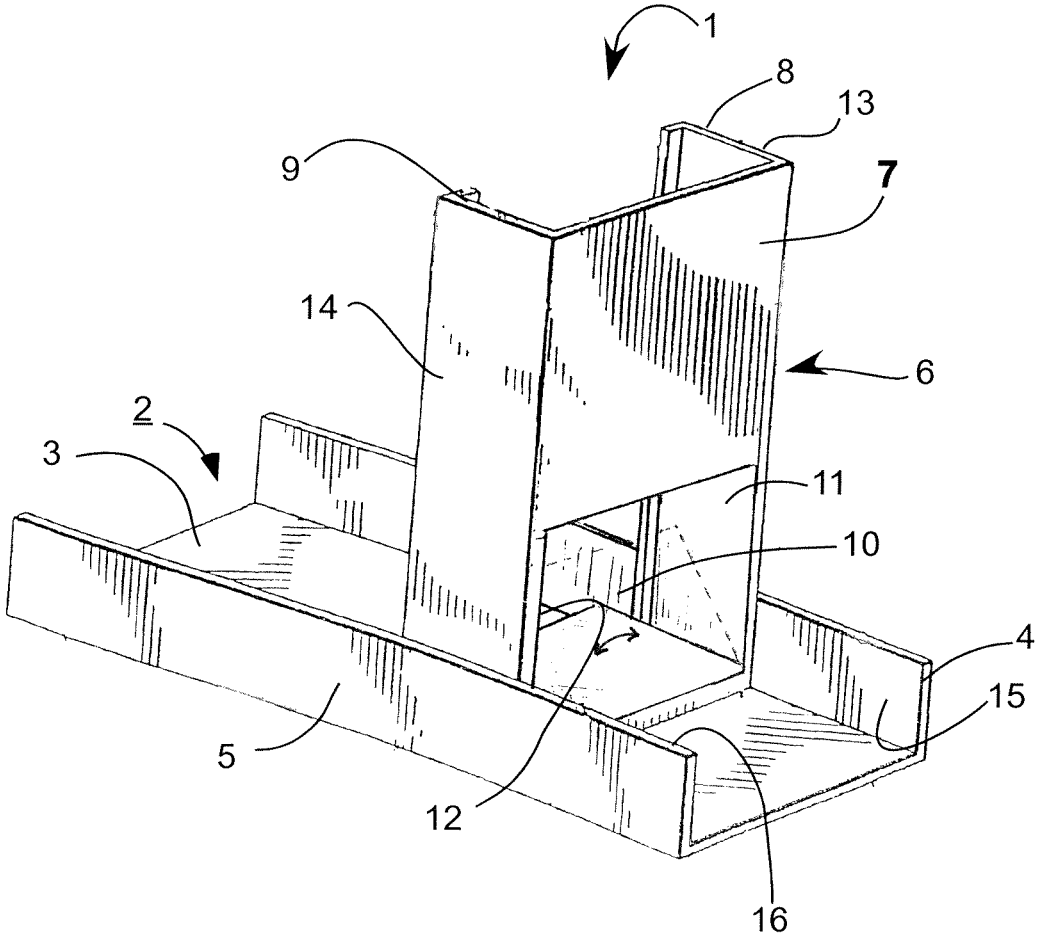
FIG. 1 shows a wall framing system according to an embodiment of the invention.

In FIG. 1 is shown a wall framing system 1 according to an embodiment of the invention. The wall framing system 1 comprises a channel member 2 with a floor portion 3 and a pair of side walls 4, 5 upstanding from said floor portion 3, a stud member 6 also having a floor portion 7 and a pair of side walls 8, 9 upstanding from said floor portion 7 for interconnection with said channel member 2, the stud member 6 being insertable between said side walls 4, 5 of the channel member 2. For obtaining a reliable and secure fixation of the stud member 6 in the channel member 2, the wall framing system 1 further comprises locking means 10 for fixating the stud member 6 to the channel member 2.

Such locking means 10 can be made up of one or more plate members 10 attached to the stud member 6.

In the embodiment shown in FIG. 1, the locking member 10 is fixed to the floor portion 7 of the stud member 6 such that, when placing the locking means, i.e. the plate member 10 in its locking position, it is exerting a force substantially perpendicular to an inner side 11, 12 of the side walls 8, 9 of the stud 6, and thereby provides an outer side 13, 14 of the side walls 8, 9 exerting a force substantially perpendicular to an inner side 15, 16 of the side walls 4, 5 of the channel member 2, thus fixating the stud 6 relative to the channel member 2.

In other embodiments the locking means 10 can be placed in or on the inner side 11, 12 of the side walls 8, 9. When brought into locking position, the locking members 10 press against each other or press against the floor portion 7 exerting a force substantially perpendicular to the inner side 11, 12 of the side walls 8, 9 of the stud 6, and thereby provide the outer side 13, 14 of the side walls 8, 9 exerting a force substantially perpendicular to the inner side 15, 16 of the side walls 4, 5 of the channel member 2, placing the stud 6 in a fixed position relative to the channel member 2.

Figure 4:
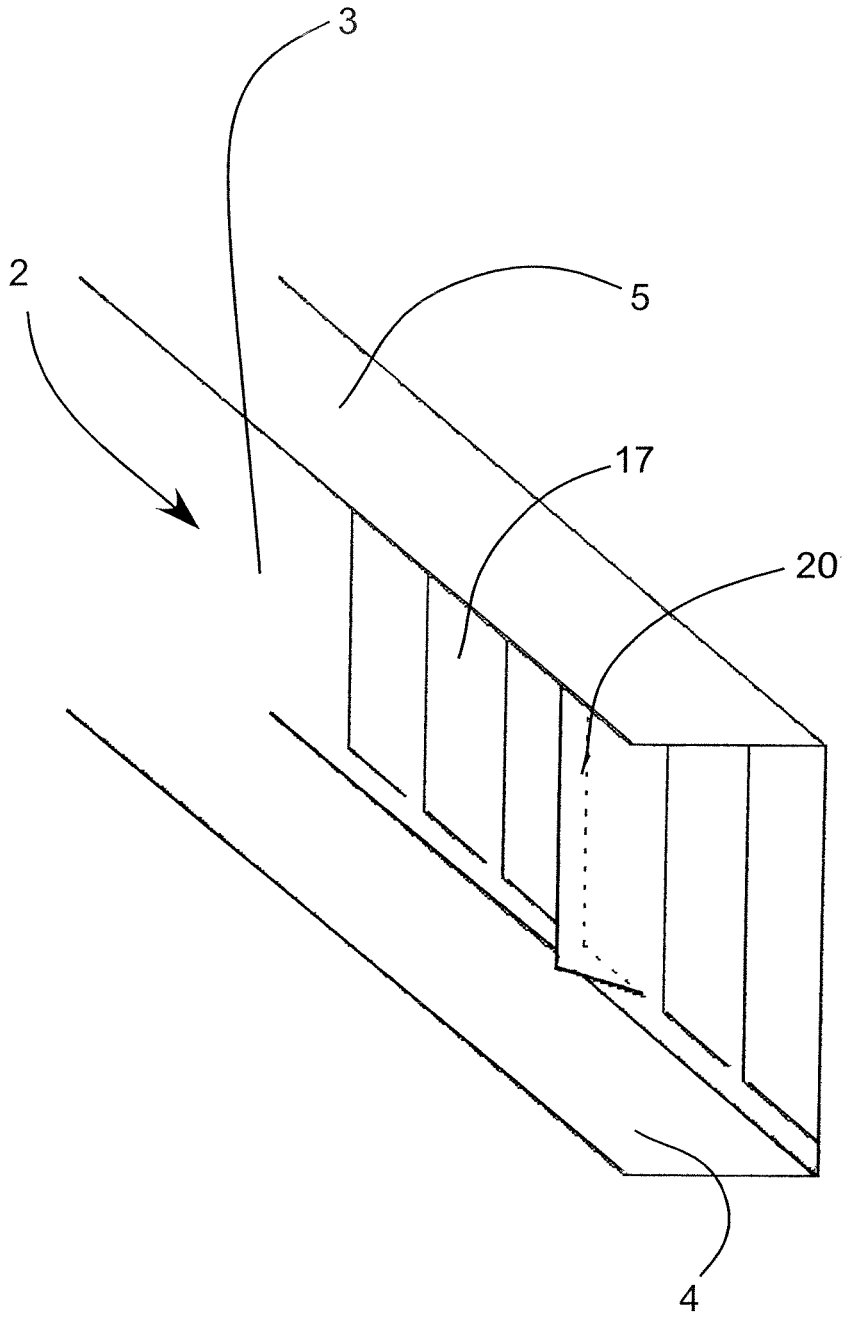
FIG. 4 shows an embodiment having locking means provided on the channel member.

In FIG. 4 is shown a further embodiment of the invention where the channel member 2 is provided with knock-out openings 17, which knock-out openings 17 are to be used as an aid for positioning the stud member 6 in the channel member 2.

A knock-out opening 17 can be explained as an opening where three in four sides of a flap are cut or punched out or nearly cut or punched out in such a way that the flap can be bent over the side of the flap still connected to the surface from which the knock out opening is made.

In a certain embodiment of this solution, the knock-out openings 17 are situated in the floor portion 3 of the channel member 2. Such a knock-out opening 17 can also engage with the side walls 8, 9 of the stud member 6, when a stud member 6 is positioned close to the knock-out opening 17. Thereby the flap 20 from the knock-out opening 17 can act as locking means able to exert a force on the inner surface 11, 12 of the side walls 8, 9 of the stud member 6 such that, when the flap 20 from the knock-out opening 17 is engaged with the stud member 6, the outer surfaces 13, 14 of the side walls 8, 9 of the stud member 6 are pressed against the inner surfaces 15, 16 of the side walls 4, 5 of the channel member 2 thereby achieving a frictional engagement between the contacting surfaces of the stud member 6 and the channel member 2.

To achieve a more precise definition of the areas where forces are acting, the side walls 8, 9 of the stud member 6 can be provided with flanges 108, 109 extending from the side walls 8, 9 towards each other.

In a further embodiment, the flanges 108, 109 can be arranged on edges of the side walls to achieve a high moment.

The stud member 6 is preferably produced from a rigid material such as metal.

In an embodiment of the wall framing system, one or more locking members 10 is/are attached to the stud member 6.

In another embodiment, one or more locking members 10 is/are moveable between an un-locked position and a locked position, in which locked position the stud member 6 is fixated in the channel member 2.

Figure 3:
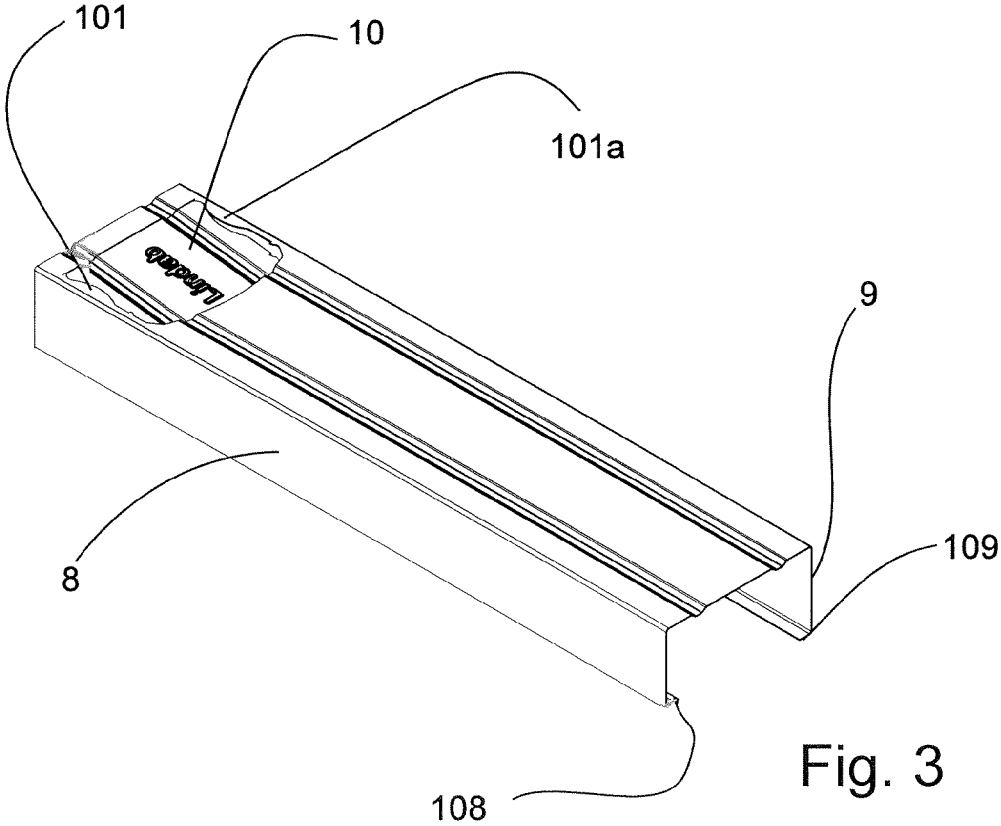

In a further embodiment of the stud member 6, as shown in FIG. 3, the locking member 10 is bent over an edge 102. When bending the locking member 10 into locking position, a pair of notches is formed (pre-cut). These notches corresponding to a pair of small projections 101, 101*a* form a kind of holding means for holding the locking member in locked position. The distance from the bending edge 102 to one projection 101 is different from the distance from the bending edge 102 to the other projection 101*a*. In this embodiment these particular distances correspond to different heights of the side walls 8, 9.

Figure 2:
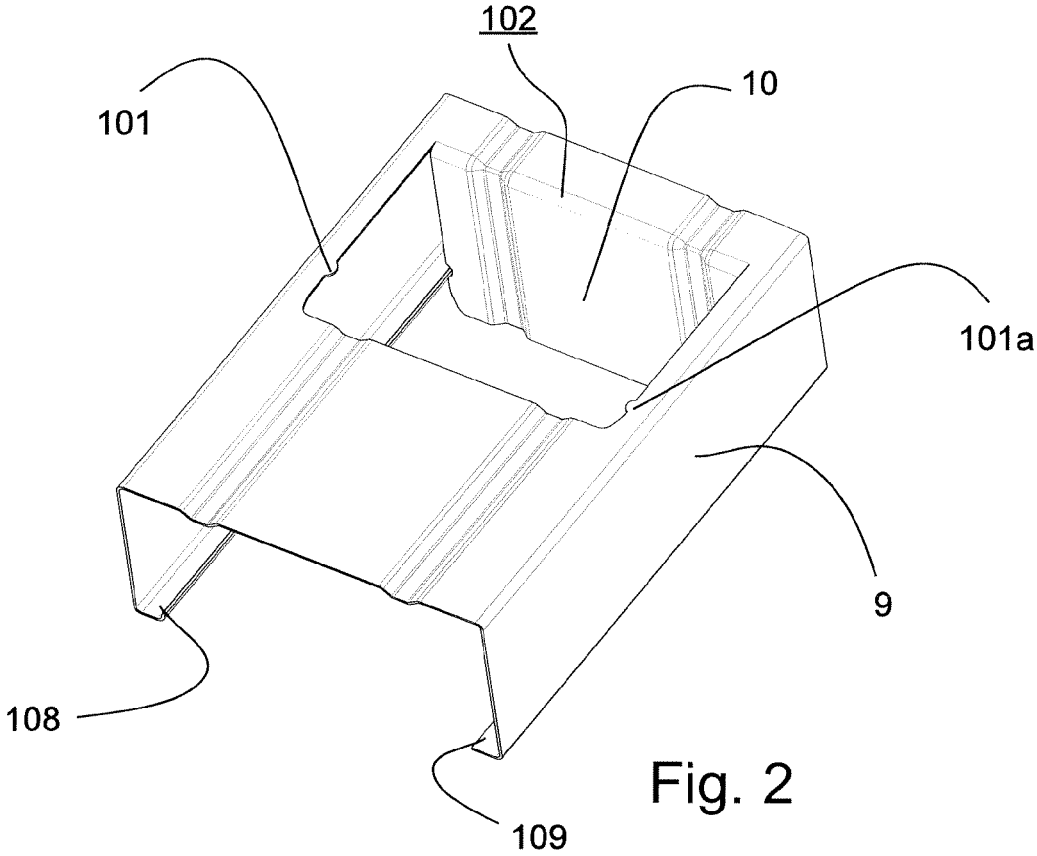
FIGS. 2 and 3 show different embodiments having locking means provided on the stud member.

Hereby the flanges 108, 109 can engage with the notches in the locking member to hold the locking member into the engaged position as shown in FIG. 2.

The features mentioned above can also be used in combination with a stud member for use in a framing system.

A method of assembling a wall framing system as described above comprises the steps of:

- Securing the channel member 2 to a building structure, such as a floor, a wall, a ceiling or the like;
- Arranging the stud member 6 between side walls 4, 5 of the channel member 2 in such a way that the side walls 8, 9 of the stud member 6 are substantially parallel to the side walls 4, 5 of the channel member 2;
- Fixating the stud member 6 in the channel member 2 by moving the locking member 10 from an un-locked position to a locked position, thereby achieving a frictional engagement between the contacting surfaces of the stud member 6 and the channel member 2.

In a further embodiment of method of assembling a wall framing system as described above, the method is carried out with following suggestive steps:

- Securing the channel member 2 to a building structure, such as a floor, a wall, a ceiling or the like;
- Arranging the stud member 6 between side walls 4, 5 of the channel member 2 in such a way, that the side walls 8, 9 of the stud member 6 are substantially in parallel with the side walls 4, 5 of the channel member 2;
- Fixating the stud member 6 in the channel member 2 by moving the locking member 10 from an un-locked position to a locked position, thereby achieving a frictional engagement between the contacting surfaces of the stud member 6 and the channel member 2.

To manufacture elements for the wall framing system, a method of manufacturing locking members in stud members and a tool for manufacturing the locking members in stud members are provided.

The profiled stud member 6 is advanced through a tool, which tool is performing three operations at a time. The first operation punches out a flap forming a locking member 10 which is held in place by a bending edge 102 allowing the flap to be bent backwards and forwards in relation to its current position. To make the bending of the locking member 10 more easy, the punching out of the flap can leave a number of points along the bending line or a line with reduced thickness of material can form the bending line in such a way that it is possible to bend the locking member 10 in relation to the floor portion 7 of the stud member 6 and it still is possible to have the locking member attached to the stud member 6 along an edge 102 of the locking member 10.

The bending edge 102 produced by the first operation is placed in the direction of the flap 10 being most forward in the operational direction. The punch or the contact surface of the punch creating the flap 10 is positioned in an inclining position in relation to the floor portion 7 of the stud member 6. This inclined position leads to a reduced need for force to perform the punching. To prevent the flap 10 from being stuck in the punching form or die, a spring biased ejector or an ejector with resilient means is provided for bringing back the punching form or die to its original position and thereby positioning the flap 10 in a position aligned with the floor portion 7 of the stud member 6 in such a way that it is possible for the stud member 6 to pass through the rest of the parts of the tool without getting stuck.

Immediately after or during the last sequence of the first operation, the second operation is performed, the second operation being a cutting operation. In the cutting operation a narrow strip is cut or punched out from the stud member 6 to achieve a desired length of the stud member 6.

After cutting or punching out the strip from the stud member 6, the same operation as the first operation is repeated just with the difference that the parts of the tool are reversed or mirrored in relation to the tool carrying out the first operation in such a way that the bending edge 102 is placed on the opposite side of the flap 10 and the stud member 6. A punch from the tool cuts the profile of the stud member 6 and at the same time forms the flap or locking member 10 in the stud member 6 which is just cut free from the profile together with the flap or locking member 10 in the profile of the next stud member 6.

The tool is placed on a kind of slide able to be advanced together with, and at the same velocity as, the profile to be cut and punched. Hereby it is possible to cut and punch the stud member 6 and still continue the profiling of the stud member 6 without stopping the profiling process.

The tool is advanced by the slide at the same velocity as the profile until the process for manufacturing a stud member profile has ended. Then the slide will return to its starting point and there await a signal or impulse initiating the next cutting and punching cycle.

It is obvious that, when manufacturing the first end of the first profile in a series, only the locking member 10 in the first end will be formed together with a cut to determine the distance from the end of the stud member 6 to the locking member 10 formed in the one end of the member or profile 6. When forming the locking member 10 in the other end of the profile 6, the cutting in length of the profile 6 and forming of the locking member 10 in the one end of the next stud member 6 will be performed in the same operational sequence and at substantially the same time.

A further advantage of having a stud member 6 provided with one or more locking members 10 in the form of knock-out openings is a possibility to join two stud members 6 into a telescopic member.

Each stud member 6 is provided with flanges 108, 109 arranged on edges of the side walls 8, 9. By having one of the side walls 8 or 9 extending further from the floor portion 7 than the other sidewall 8 or 9, it is possible to insert two stud members 6 into each other.

FIG. 2 and FIG. 3 show an embodiment, where the side wall 9 extends further from the floor portion 7 than the side wall 8.

The one side wall 8 extends a distance corresponding in such a way that the outer dimension of the one side wall 8 of the stud member 6 measured from the outer side of the underside of the floor portion 7 to the outer side of the upper side of the flange 108 is equal to or smaller than the inner dimension of the other side wall 9 of the stud member measured from the inner side of the floor portion 7 to the inner side of the lower side of the flange 109.

In a further embodiment, the two stud members 6 are dimensioned to be able to "snap" into each other when joined into each other's open profile.

When two profiles are positioned in a joined state, it is possible to displace one stud member in relation to the other stud member in a longitudinal direction thereby achieving a telescopic action.

When the two stud members are displaced into a desired position corresponding to the desired length of a stud member, which usually could be the distance from the floor to the ceiling in a building, where a wall is to be put up, the locking members of the stud members can be activated by pressure by hand or a simple tool, i.e. a shaft from a hammer, a spirit level, a screw-driver or the like.

When the locking members of the overlapping parts of the two opposite positioned and joined stud members are activated, the length of the joined stud member is fixated and the joined stud member can be placed in an upper and a lower channel member as if the joined stud member is a single stud member with the correct length for positioning it in the two channel members.

Hereby is achieved that two shorter stud members can be joined to form a longer stud member which makes the system more flexible and therefore it is not necessary to produce and keep in stock too many different lengths of stud members to meet the needs of the market.

As an example two stud members each of 150 cm can be joined to a telescopic member which can cover lengths from approximately 170 cm to 280 cm.

In the same manner other suitable lengths can be used to cover any desired intervals of length i.e. between a floor and a ceiling.

The invention claimed is:

1. A wall framing system, comprising:

a channel member having a floor portion and a pair of side walls upstanding from said floor portion;

a stud member having a floor portion and a pair of side walls upstanding from said floor portion for interconnection with said channel member, the stud member being insertable between said side walls of the channel member, the side walls of the stud member being provided with flanges extending towards each other; and locking means for fixating the stud member to the channel member, wherein said locking means includes a locking member, the locking member being formed by a knock-out opening in the floor portion of the stud member and being moveable between an unlocked position and a locked position, said locking member being arranged to exert a force on inner surfaces of the side walls of the stud member such that, when the locking member is in its locked position, outer surfaces of the side walls of the stud member are pressed against inner surfaces of the side walls of the channel member thereby achieving a frictional engagement between contacting surfaces of the stud member and the channel member.

2. A wall framing system according to claim 1 wherein the flanges are arranged on edges of the side walls.

3. A wall framing system according to claim 1, wherein the locking member, when positioned in said locked position, is exerting a force substantially perpendicular to the inner side of the side walls of the stud member, and thereby causes the outer side of the side walls to exert a force substantially perpendicular to the inner side of the side walls of the channel member.

4. A wall framing system according to claim 1, wherein the stud member is a metal stud member.

5. A wall framing system according to claim 1, wherein one of the side walls of the stud member extends further from the floor portion of the stud member than the other sidewall of the stud member.

6. A stud member for use in a framing system according to claim 1, comprising:

a floor portion;

a pair of side walls upstanding from said floor portion, the side walls being provided with flanges extending towards each other; and one or more locking members, wherein each locking member is formed by a knock-out opening in the floor portion of the stud member and is moveable between an unlocked position and a locked position, in which the locking element is in engagement with the side walls of the stud member, such that when a locking member is in its locked position, the outer surfaces of the side walls of the stud member are pressed against the inner surfaces of the side walls of the channel member thereby achieving a frictional engagement between contacting surfaces of the stud member and the channel member.

7. A stud member according to claim 6, wherein said one or more locking members comprise more than one locking member.

8. A stud member according to claim 6, wherein said flanges are arranged on edges of the side walls.

9. A stud member according to claim 6, wherein one of the side walls extends further from the floor portion than the other sidewall.

10. A method of assembling a wall framing system, comprising:

a channel member having a floor portion and a pair of side walls upstanding from said floor portion;

a stud member having a floor portion and a pair of side walls upstanding from said floor portion for interconnection with said channel member, the stud member being insertable between said side walls of the channel member, the side walls of the stud member being provided with flanges extending towards each other; and locking means for fixating the stud member to the channel member, said locking means including a locking member formed by a knock-out opening in the floor portion of the stud member;

the method comprising:

securing the channel member to a building structure, such as a floor, a wall, a ceiling or the like;

arranging the stud member between side walls of the channel member in such a way that the side walls of the stud member are substantially in parallel with the side walls of the channel member; and fixating the stud member in the channel member by moving said locking member from an unlocked position to a locked position, thereby achieving a frictional engagement between contacting surfaces of the stud member and the channel member.

11. A method of manufacturing a stud member for a wall framing system, said system comprising a channel member and stud members insertable between side walls of the channel member, wherein each manufactured stud member comprises:

a floor portion;

a pair of side walls upstanding from said floor portion for interconnection with said channel member, the side walls of the stud member being provided with flanges extending towards each other; and a locking member for fixating the stud member to the channel member, said locking member being formed by a knock-out opening at an end of the stud member;

said method comprising the steps of:

passing a profile into a cutting and punching tool, said profile having a floor portion and a pair of side walls;

forming, at substantially the same time, two locking members by punching out a respective knock-out opening in the floor portion of said profile; and when forming said two locking members, cutting the profile between the locking members to form a new stud member of a predetermined length.

12. A method according to claim 11, wherein the tool that performs the cutting and/or punching action is advanced at substantially the same velocity along with the stud members to be cut and punched.

13. A method of joining stud members into a length-adjustable stud member of a wall framing system, said system comprising:

a first channel member and a second channel member positioned at a floor and in a ceiling, respectively, wherein each channel member has a floor portion and a pair of side walls upstanding from the floor portion; and a first stud member and a second stud member, wherein each stud member has a floor portion and a pair of side walls upstanding from the floor portion of the stud member for interconnection with one of the channel members, wherein the side walls of the stud member are provided with flanges extending towards each other, wherein each stud member is insertable between said side walls of one of said channel members, and wherein each stud member has two locking members formed by a respective knock-out opening at opposite ends of the floor portion of the stud member;

the method comprising:

joining the first and second stud members by joining an open side of their profile into each other, thereby forming a length-adjustable stud member;

displacing the first and second stud members in relation to each other in their longitudinal direction until they are able to engage with said channel members; and activating locking members of the stud members arranged at the overlapping ends of the stud members to lock the stud members in relation to each other and activating locking members arranged at the ends of the stud members placed in the channel members to lock each stud member in relation to a respective channel member.

* * * * *